US007080585B2

(12) United States Patent
Prudhomme

(10) Patent No.: US 7,080,585 B2
(45) Date of Patent: Jul. 25, 2006

(54) HOLD-DOWN CLAMP FOR SLITTER-PUNCH

(75) Inventor: Andrew D. Prudhomme, Seneca Falls, NY (US)

(73) Assignee: Pearl Technologies, Inc., Savannah, NY (US)

( * ) Notice: Subject to any disclaimer, the term of this patent is extended or adjusted under 35 U.S.C. 154(b) by 0 days.

(21) Appl. No.: 10/244,114

(22) Filed: Sep. 16, 2002

(65) Prior Publication Data

US 2004/0050230 A1 Mar. 18, 2004

(51) Int. Cl.
*B26D 1/06* (2006.01)

(52) U.S. Cl. ..... 83/143; 83/587; 83/639.1

(58) Field of Classification Search ..... 83/143, 83/140, 639.1, 586, 587
See application file for complete search history.

(56) References Cited

U.S. PATENT DOCUMENTS

| | | | | |
|---|---|---|---|---|
| 706,279 | A * | 8/1902 | Temple | 83/131 |
| 2,602,507 | A * | 7/1952 | Adams | 83/587 |
| 3,722,337 | A * | 3/1973 | Brolund et al. | 83/137 |
| 3,802,308 | A | 4/1974 | Davis, Jr. | 83/99 |
| 3,939,743 | A * | 2/1976 | Coombes | 83/98 |
| 3,973,453 | A * | 8/1976 | Tameo | 83/30 |
| 4,516,448 | A * | 5/1985 | Hill et al. | 83/137 |
| 4,646,599 | A * | 3/1987 | Benedict | 83/131 |
| 4,841,822 | A | 6/1989 | Gerber | 83/174 |
| 5,114,394 | A | 5/1992 | Madsen | 493/277 |
| 5,613,416 | A * | 3/1997 | Fujita | 83/98 |

OTHER PUBLICATIONS

Early Office Museum Antique Stapler Gallery—Paper Fastener Punches (www.officemuseum.com/stapler_gallery_miscellaneous.htm), date unk.

* cited by examiner

*Primary Examiner*—Kenneth E. Peterson
(74) *Attorney, Agent, or Firm*—Bernhard P. Molldrem, Jr.

(57) ABSTRACT

A clamping arrangement is provided for a slitter and/or hole punch for a plastic film processing machine. The punch can be unitarily formed on a base member, and mounted on a block that is affixed to the end of an actuator rod. A double-acting pneumatic cylinder actuator serves as the reciprocating mechanism for the punch. A hold-down clamping mechanism includes an apertured clamping plate and frame that surrounds the punch and is spring-driven using a compression spring mounted over the shaft or rod of the actuator. The compression spring compresses on the upstroke, and assists the cylinder on the downstroke.

11 Claims, 4 Drawing Sheets

HOLD-DOWN CLAMP FOR SLITTER-PUNCH

BACKGROUND OF THE INVENTION

The present invention relates to punches and apparatus for perforating film material such as polyethylene film or other films made of plastic resin. The invention is more particularly directed to an improved punch or slitter-punch and adapter combination. The invention is specifically directed to a hold-down clamp for holding the plastic film steady as the punch acts to form a hole, and which raises to release the film when the punch head is raised.

Blades, punches, and cutters for forming holes and slits in plastic film material are described in prior U.S. Pat. Nos. 4,748,920 and 4,723,466 of Earl T. Pottorff. There, a self-sharpening hole punch formed of a low-friction, semi-rigid material, such as a polymer or a similar plastic resin. The hole punch has a thread at its upper end for screw mounting onto reciprocating apparatus, which may be actuated by a pneumatic cylinder. Slit cutters are separately mounted on the reciprocating mechanism and spaced a small distance from the hole punch to create a gap in the film between the resulting hole and slit.

A so-called quick-slip punch adapter for a plastic bag making machine is described in U.S. Pat. Nos. 5,035,165 and 5,114,394. In that arrangement, a slitter blade is held in a clamp that also fastens to the shaft or rod that holds a hole cutter. However, the slitter blade is a separate element and has to be changed out separately from the hole punch. Also, this requires the operator to employ tools to remove the worn blades and punches, and to replace them with fresh ones. This operation can take several minutes for each hole punch and slitter blade. As there are several of these on each bag machine, considerable down time may be required to replace the worn blades and cutters.

Also, when the space between the slitter blade and the hole punch is to be changed, this must be done by hand and the gap between the slitter and the hole punch must be carefully measured. Moreover, the slitter blade itself has always been made of steel, and suffers the problems of dulling and wear that characterize steel cutting heads, which problem is discussed in the above-mentioned U.S. Pat. Nos. 4,748,920 and 4,723,466. Consequently, the industry has long sought a solution to the problem of how to effect rapid change out of both hole punch and slitter blade, how to effect proper alignment of the parts in the desired spacing, and how to increase the wear life of the parts.

U.S. Pat. No. 6,148,710 discloses a slitter and hole punch and quick change adapter combination which fits a bag machine or similar equipment for punching holes and slits in a web of plastic film material. In that arrangement, a hole punch and a slitter blade are unitarily formed on a base member. Left and right resilient arms extend from distal to proximal, and have free ends that project proximally of the base member. The quick adapter can be an extruded block with a T-channel formed on a lower side with a passage or gap to accommodate the hole punch and the slitter blade. The T-channel has inwardly directed flanges that create side recesses to accommodate the resilient arms of the slitter-and-hole-punch. The side recesses have cooperating hollows to receive detents of the associated resilient arm. The slitter-and-hole-punch can be slid in and out of the T-slot, and when slid in, the detents on the resilient arms keep it in position. The slitter-and-hole-punch can be changed out in a few seconds by hand. The punches can be color coded for barrel diameter, gap size, etc.

A combination of a slitter punch with a hold-down plate arrangement is described in U.S. patent application Ser. No. 09/713,392, now abandoned. This arrangement includes means for clamping the film in place momentarily while the punch mechanism is fired, and then releasing the film immediately thereafter. In the arrangement described in that patent application, there is one air cylinder used for driving the punch, and two additional cylinders needed for driving the clamping plate. The actuation of the various cylinders is synchronized in that case by selecting the clamp plate cylinders to be of smaller size than the cylinder that drives the punch cutting head.

In other designs, a spring is used to bias between the cutting head and the frame on which the hold-down plate is mounted. This arrangement drives the hold down plate against the base plate or backing plate with the downward motion of the cutting head. The result is that the spring is compressed on each downward stroke, and this can lead to spring failure due to fatigue. In addition, the spring bias is directed against the cutting motion of the cutting head, which slows down the motion of the cutting head during a punching operation. As a result the air cylinder has to be oversized by an amount to counter this spring force.

OBJECTS AND SUMMARY OF THE INVENTION

Accordingly, it is an object of this invention to provide a cutter or cutter and slitter arrangement that includes suitable clamping means to assist in the punching operation thus creating a cleaner punched hole or slit, and which avoids the drawbacks of the prior art.

It is another object of the invention to provide film punch and hold-down clamp which avoids the major cause of spring failure, and which has the spring oriented so that the spring force assists in accelerating the punch head.

It is a further object to provide a combination punch and hold-down film clamp that is of simple design and can enjoy a long life and low maintenance costs.

According to one aspect of the present invention, a slitter-and-hole-punch is provided with a film hold-down clamp that actuates to hold the plastic film in place a short interval before the cutting head or punch reaches the film, and which ascends to release the film when the head rises. Several possible embodiments can be used in connection with a bag machine or similar apparatus where holes and slits must be created in a web of film material. The apparatus employs an apertured backing plate on which the film is supported and a reciprocating mechanism for holding the slitter punch cutting head in registered alignment with the film and with one or more corresponding apertures in the backing plate. The reciprocating mechanism uses a double acting air cylinder or the equivalent for moving the slitter punch cutting head in the up/down or vertical direction (i.e., substantially normal to the backing plate). In a favorable arrangement, the slitter-and-hole-punch is a unitarily formed member, e.g., molded of a durable semi-rigid plastic resin, and includes a base member, a hole punch, a slitter blade, and left and right resilient arms unitarily formed at left and right sides of the base member. The hole punch and the slitter blade are each unitarily formed with the base member and extend downward (in the direction towards the apertured plate) with the slitter blade being positioned distally of the hole punch. The left and right resilient arms extend from distal to proximal, and have free ends that project proximally of the base member. Each resilient arm has a detent member formed on it. The base and resilient arms define a generally bar-shaped profile across the proximal-distal direction thereof. The slitter-punch can be configured as disclosed in U.S. Pat No. 6,148,710, which is incorporated herein by reference.

The quick adapter for holding the punch or slitter-punch head can be in the form of a block having threads for attaching to the rod of the air cylinder. An assortment of hole-punch units and slitter-and-hole-punch units can be provided with different diameter hole punches and with different size gaps between the slitter blade and the hole punch. Because these units are molded of plastic, they can be color-coded by gap size, or by the size of the barrel of the hole punch, or both. The color coding also permits the operator to visually check the gap size or punch size without having to stop the machine to measure.

A clamp arrangement or hold-down clamp is included as a part of the punch mechanism. The reciprocating mechanism, namely, the double acting cylinder on which the adapter is mounted is pneumatically actuated via a first air inlet to produce an upward motion to raise the cutting head, and is pneumatically actuated via a second air inlet to produce a downward punching motion. A coil compression spring is mounted below the cylinder and rests against the upper part of the frame of the hold-down clamp. This spring is pre-biased to urge the hold-down clamp towards the backing plate. When the air cylinder is actuated to lift the cutting head, the quick adapter block, on which the cutting head is mounted, coacts with the frame of the hold-down clamp to compress the spring. Then when air pressure is applied to the second air inlet to drive the cutting head downward, the spring urges the clamp against the film, and thereafter the cutting head continues the punching motion without interference from the hold-down clamp. The initial action of the spring drives both the clamp and the cutting head downward, which initially accelerates the punch and aids in the punching operation. A small rubber cushion can be employed between the upper part of the quick adapter block and the occluding surface of the hold down clamp frame, which quiets the punching operation. Also a vertical guide mechanism can be employed to maintain the position of the hold-down clamp, including a tab or flange extending outward from the back of the clamp frame, and a vertical channel member in which the tab or flange can ride.

The punches can be slitter punches, which form a hole and a slit simultaneously, or they may be configured as slitters, perforators, multiple hole punches, or single hole punches, oval punches, or punches to create other geometrical shapes. Also, while terms of orientation, such as vertical, downward, left and right are used in respect to the embodiment described below, it should be appreciated that such terms are used for simplifying the description, and that the principles of this invention would be the same regardless of the positional orientation of the apparatus.

The above and many other objects, features, and advantages of this invention will become apparent from the ensuing description of an exemplary embodiment, which should be read in conjunction with the accompanying Drawing.

DETAILED DESCRIPTION OF THE PREFERRED EMBODIMENTS

Figure 1:
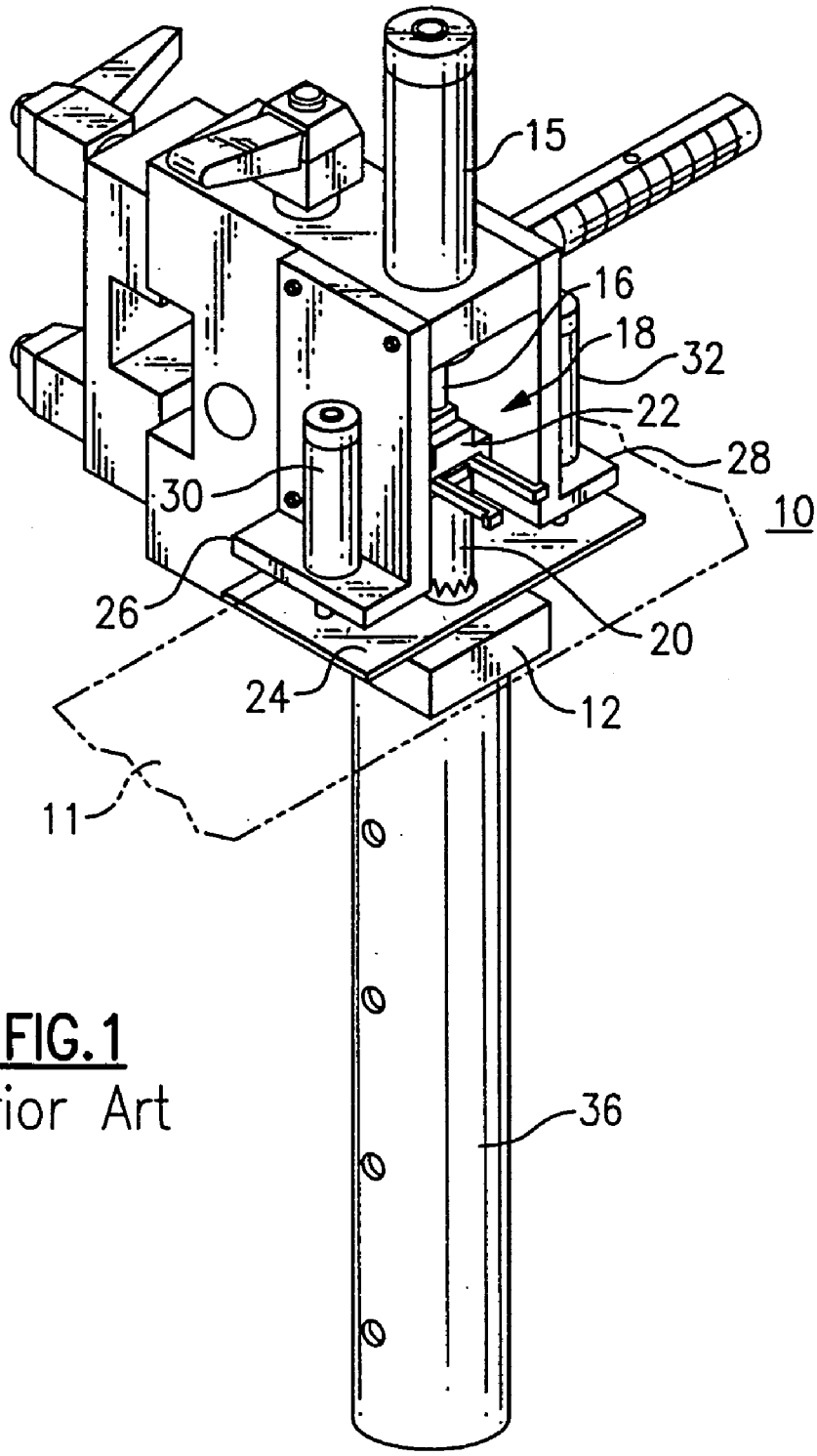
FIG.1 Prior Art
FIG. 1 is a perspective view of apparatus for creating punched holes and slits in a plastic film, including a pneumatic hold-down clamp according to the prior art.

With reference to the Drawing, FIG. 1 illustrates an operative portion of a current bag machine or similar punching apparatus 10 for forming holes and/or slits in a plastic film 11. An apertured backing plate 12 supports the film 11, and has a round opening and a slot opening (not shown), with which a hole punch and slitter blade are aligned. A reciprocating actuator 15 has a shaft 16 that moves up and down with respect to the backing plate, and a vertical channel (not shown) is situated distally of the shaft 16. The reciprocating actuator 15 can be a pneumatic cylinder. A slitter punch and quick adapter assembly 18, e.g, as described in U.S. Pat. No. 6,148,700, can be fitted onto a threaded end of the shaft 16, and this includes a punch unit 20 that serves as the cutter head for the punching apparatus 10. As shown, the slitter punch unit 20 has a base plate, with a circular hole punch and a slitter blade that are aligned respectively with the openings in the backing plate 12. A tab and channel arrangement aligns the cutting head and maintains registry of the cutting head 20 with the backing plate 12. The slitter punch unit slidably seats in an adapter 22, which is affixed to the bottom end of the shaft 16.

As further shown in FIG. 1, a clamping plate 24 is situated between the slitter punch unit 20 and the apertured backing plate 12. Here, the clamping plate has an opening or openings that correspond to the openings in the backing plate, and align with them. There are L-shaped support shelves 26 and 28 affixed on left and right sides of the reciprocating mechanism, respectively. Each of these shelves mounts a respective air cylinder 30 and 32, and each has a vertically oriented rod and to which the clamping plate 24 is mounted. An air line 34 is shown here supplying compressed air to the three cylinders 15, 30, and 32. The cylinders 30 and 32 are about one-half the size of the main cylinder 15, in terms of volume or displacement, so that the cylinders 30 and 32 move first when compressed air is applied. The result is that there is a small time delay after the downward clamping motion of the plate 24 before the punching motion of the punch unit 20. The second cylinders 30 and 32 actuate prior to the main cylinder 15 and punch unit 20, so there is a sufficient time delay before the punch unit 20 is fired. Then when the air pressure is relieved, the punch unit 20 ascends and the clamping plate 24 releases. In alternative arrangements, in place of the air cylinders electromagnetic or electromechanical actuators could be used. A waste tube 36 beneath the backing plate 12 receives the punched out film waste that is removed from the film 11, and this waste can be recycled or disposed of.

Figure 2:
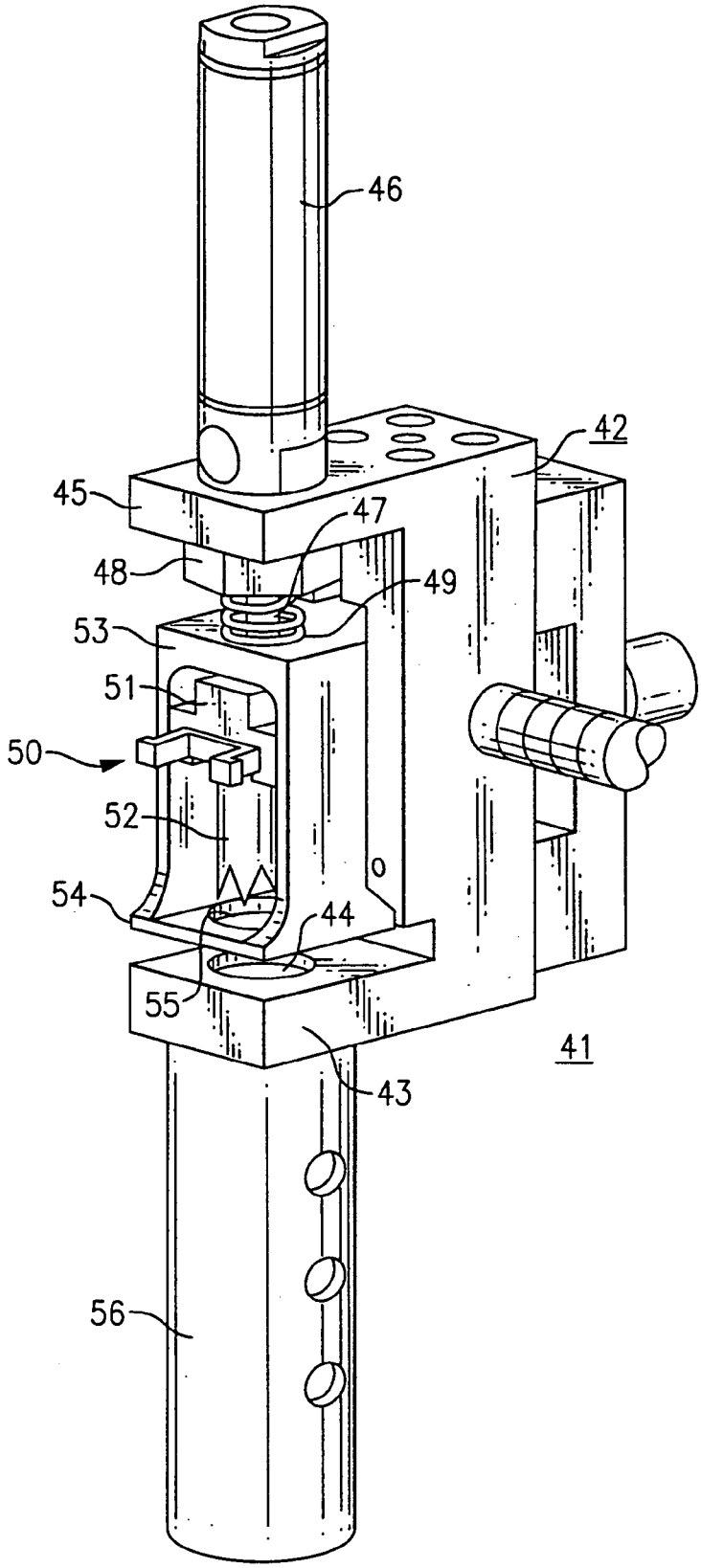
FIG. 2 is a perspective view of a punch apparatus with a spring-actuated hold-down clamp according to one embodiment of this invention.
Figure 3:
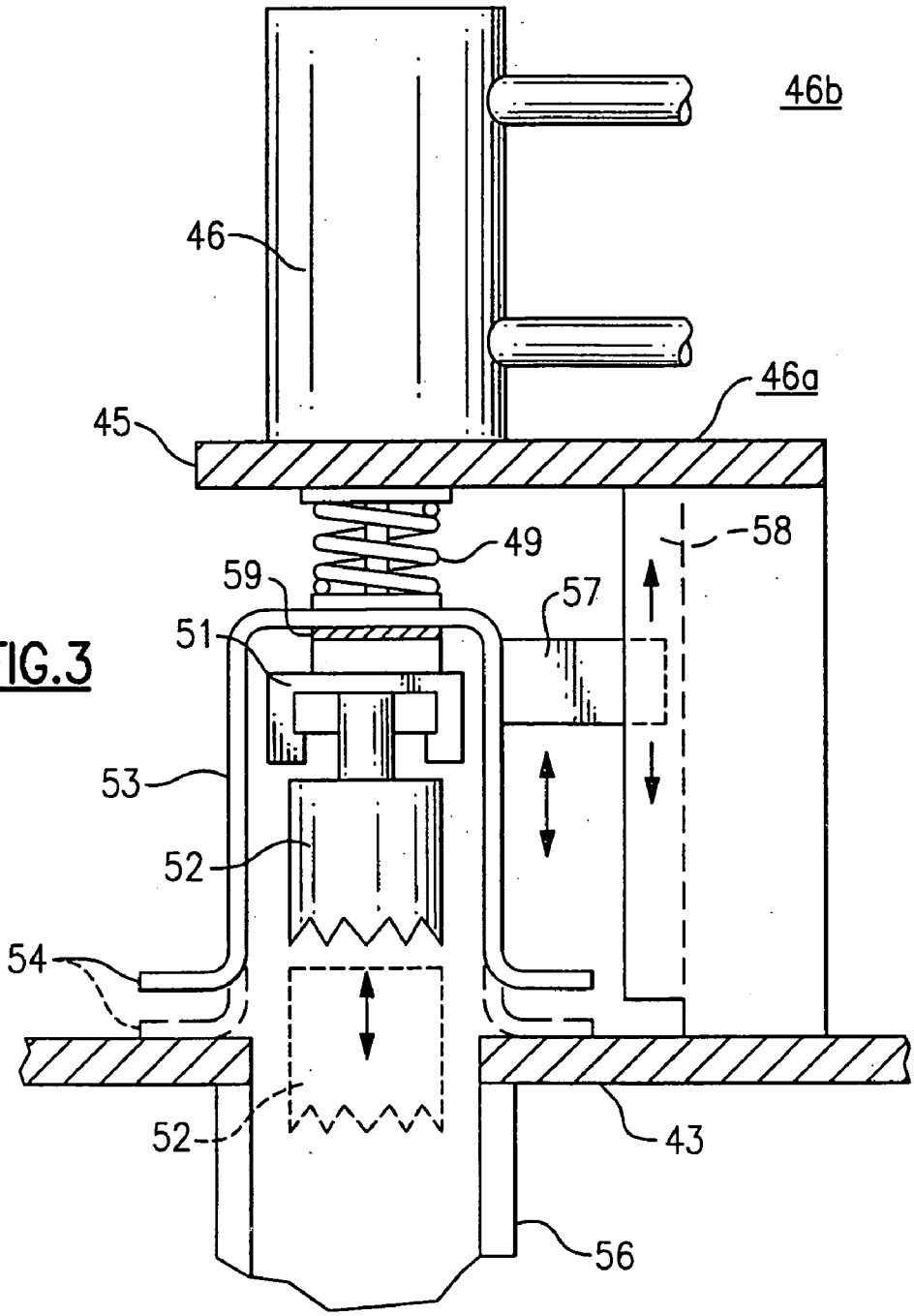
FIG. 3 is schematic elevational view of this embodiment.
Figure 4:
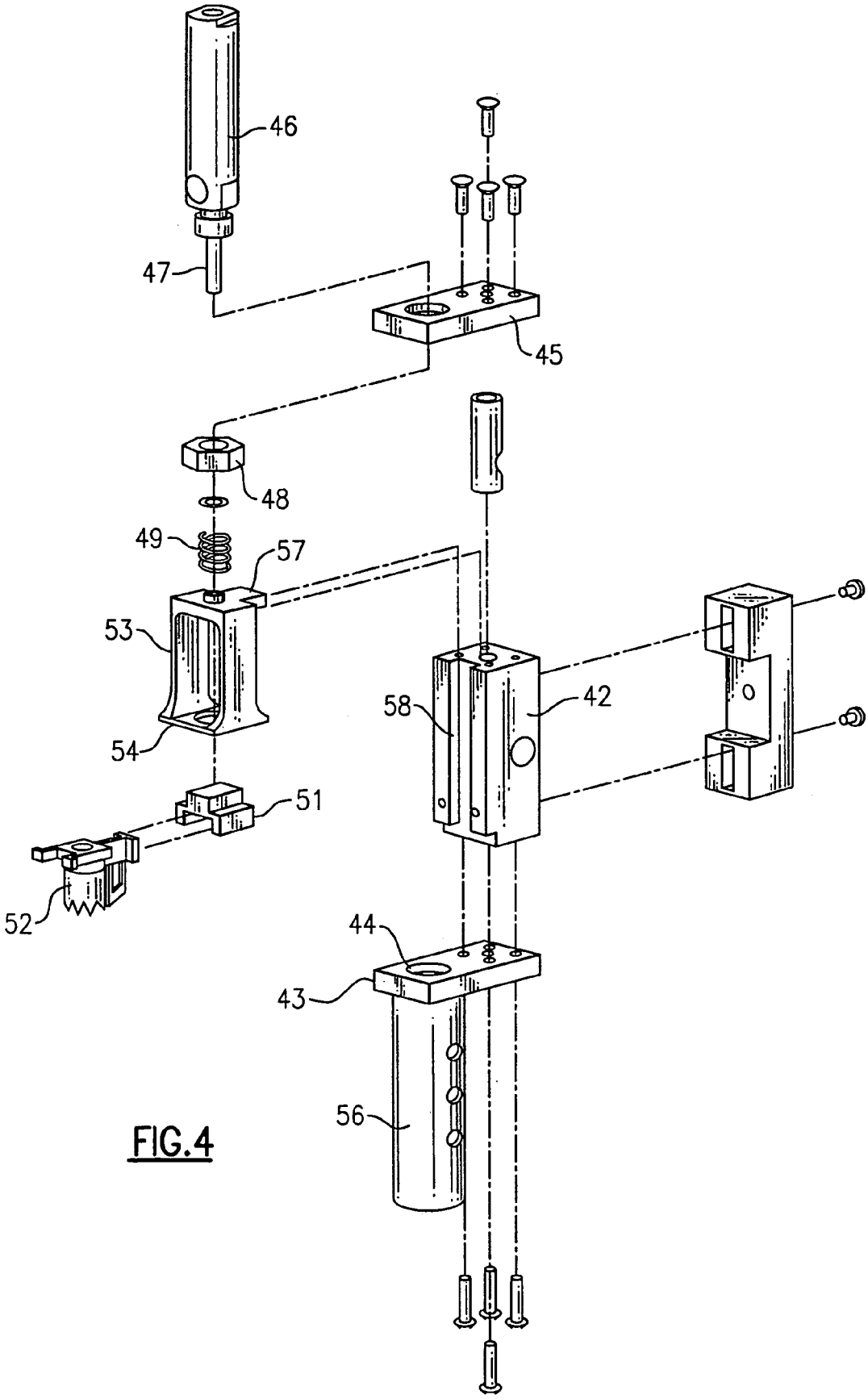
FIG. 4 is an assembly view of this embodiment.

A rapid action punch assembly 41 according to one embodiment of this invention is shown if FIGS. 2, 3, and 4. The film 11 is omitted for reasons of clarity. The punch assembly 41 has a generally vertical block member 42 at the lower end of which is connected a backing plate 43, with an aperture 44 as discussed in reference to FIG. 1. At the upper end of the block member 41 is a mounting flange 45, on which a double-acting air cylinder 46 is mounted, with the cylinder rod 47 oriented vertically beneath the flange 45. A mounting nut 48 threads onto one end of the cylinder 46 to hold the same in place in the flange 45. As discussed further below, a coil compression spring 49 is situated below the mounting nut 48 and flange 45 with the rod 47 passing through the open core of the spring 49.

The punch head assembly 50 has a mounting block or plate 51 that is threaded onto the lower end of the cylinder rod 47, and a replaceable plastic cutting head 52, which can be of the type described in U.S. Pat. No. 6,148,710, for example. A hold-down clamp arrangement includes a frame or housing 53 that surrounds the punch head assembly 50, and has an upper portion that contacts against the lower end of the coil compression spring 49. A clamp plate 54 is supported in the frame 53 at the lower end thereof beneath the punch head assembly 50, and this plate 54 has an aperture 55 that aligns with the cutting head 52 and also with the aperture 44 in the backing plate 43. The spring 49 biases the frame 53 and clamp plate 54 downwards towards the backing plate 43, while upward motion of the punch assembly 50 lifts the hold down clamp plate 54 and compresses the spring 49. A waste tube 56 is shown beneath the backing plate to receive disks or cutouts of film that are punched from the film 11 by the cutting head 52.

There is an opening in the front side of the frame 53, visible in FIG. 2, through which the punch head assembly 50 can be accessed so that it may be removed and changed out.

As shown schematically in FIG. 3, the cylinder 46 is double acting, which means that compressed air is applied, e.g., into inlet 46*a,* to displace the piston and rod 47 upwards, and air is applied, e.g., into inlet 46*b,* to displace the piston and rod 47 downwards, i.e., to drive the cutting head 52 into the film and through the aperture in the backing plate. As can be understood, the compression spring 49 is compressed on the lift stroke or upstroke, and not on the drive stroke or down stroke. The compression spring 49 acts in the drive direction on the punch 50, that is, the spring 49 actually serves to accelerate the punch 50.

As also shown in FIGS. 3 and 4, there is a tab or flange 57 that extends back from the frame of the hold down clamp 53, and this travels up and down in a guide groove or channel 58 formed on a front side of the block member 42. As also shown in FIG. 3, a rubber grommet 59 is situated between the top of the head assembly block 51 and the upper part of the frame 53 of the hold-down clamp. This grommet 59 serves as a cushion and achieves quieter operation.

There are many equivalents to the foregoing preferred embodiment, which may be employed depending on the manufacturing requirement. For example, the double action actuator could be a hydraulic cylinder, or an electromagnetic or electromechanical actuator. Also, the compression spring could be a leaf spring or other known spring, depending on the design of the bag machine.

While this invention has been described in detail with reference to a selected preferred embodiments, it should be recognized that the invention is not limited to those embodiments. Rather, many modifications and variations will present themselves to persons skilled in the art without departing from the scope and spirit of the invention, as defined in the appended claims.

I claim:

1. An automated high-speed punch apparatus adapted for use in a bag machine for punching holes and/or slits in a web of film material, said apparatus including an apertured backing plate on which said web is supported, a cutting head for punching a hole and/or slit in the film material, reciprocating means for holding the head in registered alignment with said film material and with corresponding apertures in said backing plate, and for moving the cutting head in a direction that is substantially normal to the backing plate on which the web of film material is affixed, and a hold-down clamp including a clamping plate situated above the backing plate and having an aperture therein in alignment with one or more corresponding apertures in said backing plate, and through which the cutting head passes when the bold-down clamp is biased against the web of film material on the backing plate, and a clamp frame on which said clamping plate is supported, the cutting head being situated within the clamp frame, and with said reciprocating means being operatively coupled to the frame of the clamping plate to urge said clamping plate against the backing plate when the cutting head descends and to lift the clamping plate off the backing plate when said cutting head rises;

said reciprocating means comprising the improvement in which the reciprocating means further includes a double-acting air cylinder having a first air inlet in which compressed air enters for moving a rod of said cylinder to a raised position for raising said cutting head and a second air inlet through which compressed air enters for driving the cylinder rod to a lowered position for driving said cutting head through the film material;

a spring situated between said cylinder and a top member of said hold-down clamp for urging said hold-dawn clamp towards said backing plate; and holder means mounted on a distal end of said rod and disposed between said cutting head and the top member of said hold-down clamp for mounting said cutting head and for raising said hold-down clamp and compressing said spring when said double-acting air cylinder moves said rod to the raised position for raising said hold-down clamp when said cutting head is raised;

wherein said hold-down clamp frame includes said top member situated above said holder means, and sides that extend from said top member to said clamping plate and contain said cutting head within said frame, the frame having means therein to access said cutting head and to permit the cutting head to be changed out; and wherein said rod passes through an opening in the top member of said frame to the holder means for said cutting head; and wherein said spring is situated over said rod between an upper part of said hold-down clamp and an abutment connected with a lower end of said cylinder;

said spring being pre-biased to urge the hold-down clamp towards the backing plate such that when said air pressure is applied to the second air inlet of the double-acting cylinder, the spring serves to accelerate the cutting head towards the web of film material.

2. The apparatus of claim 1 wherein said apparatus is adapted for use in a plastic film bag machine for automated high-speed punching of holes and/or slits in a plastic film.

3. The apparatus of claim 1 wherein said holder means for said cutting head includes a rubber cushion for contacting said hold-down clamp, the rubber cushion being disposed between the holder means for said cutting head and an occluding surface of the top member of said clamp frame.

4. The apparatus of claim 1 wherein said spring is a coil compression spring.

5. The apparatus of claim 1 wherein said hold-down clamp includes a guide tab, and said apparatus further comprises a member having a guide channel therein oriented in a direction parallel to the motion direction of said punch cutting head, with said tab riding in said guide slot.

6. The apparatus of claim 1 wherein said means to access said cutting head includes an aperture at one side of said clamp frame.

7. An automated high-speed punch apparatus adapted for use in a bag machine for punching holes and/or slits in a web of film material, said apparatus including an apertured backing plate on which said film is supported, a cutting head for punching a hole and/or slit in the film material, reciprocating means including holder means for holding the cutting head in registered alignment with said film material and with corresponding apertures in said backing plate, and including means for moving the cutting head in a direction that is substantially normal to said backing plate on which the film material is supported, and a hold-down clamp including a clamping plate situated above said backing plate and having at least one aperture therein in alignment with one or more corresponding apertures in the backing plate and through which said cutting head passes when said hold-down clamp is biased against the film material on said backing plate; with said reciprocating means acting to urge said clamping plate against said backing plate when said cutting head descends and acting to lift said clamping plate of said backing plate when said cutting head rises; said reciprocating means including a double-acting actuator with first means for applying energy for moving a reciprocating rod of said actuator to a raised position for raising said cutting head and a second means for applying energy for driving the reciprocating rod to a lowered position for driving said cutting head through the web of film material;

a spring situated between said actuator and a top member of said hold-down clamp for urging said hold-down clamp towards said backing plate; and said holder means situated between said cutting head and below the top member of said hold-down clamp for raising said hold-down clamp and compressing said spring when said double-acting actuator moves said reciprocating mechanism to the raised position for raising said hold-down clamp and compressing said spring when said cutting head is raised, wherein said rod passes thru an opening in the top member of said frame to the holder means for said cutting head;

wherein said hold-down clamp includes a frame having said top member, sides that surround said holder means and said cutting head with said clamping plate affixed onto said sides beneath said cutting head; and means to access said cutting head to permit the cutting head to be changed out;

said spring being pre-biased to urge the hold-down clamp, said holder means and said cutting head towards the backing plate such that when said second means applies energy to the double-acting actuator, the spring serves to accelerate the cutting head towards the web of film material.

8. The apparatus of claim 7 wherein said means to access said cutting head includes an aperture at one side of the frame.

9. The apparatus of claim 7 wherein said spring is a coil compression spring.

10. The apparatus of claim 8 said holder for said cutting head includes a rubber cushion for contacting said hold-down clamp, the rubber cushion being disposed between the holder for said cutting head and an occluding surface on the top member of said clamp frame.

11. The apparatus of claim 7 wherein the apparatus is adapted for use in a plastic bag machine for automated high-speed punching of holes and/or slits in a plastic film.

* * * * *

UNITED STATES PATENT AND TRADEMARK OFFICE

CERTIFICATE OF CORRECTION

PATENT NO. : 7,080,585 B2
APPLICATION NO. : 10/244114
DATED : July 25, 2006
INVENTOR(S) : Andrew D. Prudhomme It is certified that error appears in the above-identified patent and that said Letters Patent is hereby corrected as shown below:

Col. 6, Claim 1, line 2: "bold-down" should read --hold-down--

Col. 6, Claim 1, line 22: "hold-dawn" should read --hold-down--

Signed and Sealed this

Fifth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 7,080,585 B2
APPLICATION NO. : 10/244114
DATED : July 25, 2006
INVENTOR(S) : Andrew D. Prudhomme It is certified that error appears in the above-identified patent and that said Letters Patent is hereby corrected as shown below:

Col. 6, Claim 1, line 2: "bold-down" should read --hold-down--

Col. 6, Claim 1, line 22: "hold-dawn" should read --hold-down--

Signed and Sealed this

Twenty-sixth Day of December, 2006

JON W. DUDAS
*Director of the United States Patent and Trademark Office*